US008092229B2

(12) United States Patent
Suzuki et al.

(10) Patent No.: US 8,092,229 B2
(45) Date of Patent: Jan. 10, 2012

(54) RELAY CONNECTOR

(75) Inventors: Hisashi Suzuki, Tokyo (JP); Ryoichi Hirako, Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 12/694,825

(22) Filed: Jan. 27, 2010

(65) Prior Publication Data

US 2010/0190359 A1 Jul. 29, 2010

(30) Foreign Application Priority Data

Jan. 28, 2009 (JP) ..... P. 2009-016602

(51) Int. Cl.
*H01R 12/00* (2006.01)

(52) U.S. Cl. ..... 439/63

(58) Field of Classification Search ..... 439/63, 439/92, 122; 307/112; 200/51 R; 174/51
See application file for complete search history.

(56) References Cited

U.S. PATENT DOCUMENTS

| | | | | |
|---|---|---|---|---|
| 7,575,474 | B1 * | 8/2009 | Dodson et al. | 439/581 |
| 2004/0119557 | A1 * | 6/2004 | Barnes et al. | 333/33 |
| 2008/0139009 | A1 * | 6/2008 | Suzuki et al. | 439/63 |

FOREIGN PATENT DOCUMENTS

JP 2008-171801 7/2008

* cited by examiner

*Primary Examiner* — Alexander Gilman
(74) *Attorney, Agent, or Firm* — Morgan, Lewis & Bockius LLP

(57) ABSTRACT

A core conductor of a coaxial connector is electrically connected to a terminal electrode which is provided at an end of a surface of a board, and a shell GND of the coaxial connector is electrically connected to a GND electrode which is provided at an end of a back surface of the board in a relay connector. The shell GND has a substantially columnar outer shape. The relay connector includes: a conductive first block having a first surface and a second surface being opposite to the first surface, the first block formed with a through hole, the coaxial connector being provided in the through hole, a part of the shell GND being provided in the through hole, the core conductor of the coaxial connector being projected from the first surface of the first block; and a conductive second block provided with a board rest part on which the board is to be placed, the second block operable to relatively move with respect to the first block and being electrically connected to the first block.

5 Claims, 11 Drawing Sheets

RELAY CONNECTOR

BACKGROUND OF THE INVENTION

The present invention relates to a relay connector for electrically connecting a core conductor of a coaxial connector to a terminal electrode which is provided on a surface of a board, and for electrically connecting a shell ground (GND) of the coaxial connector to a GND electrode which is provided on a back surface of the board, for the purpose of inspecting the board.

In designing and producing a high frequency circuit board or the like, it is necessary to evaluate its performance in a course of designing. Therefore, by electrically connecting a core conductor of a coaxial connector to a terminal electrode which is provided at an end of a surface of the board, and by electrically connecting a shell GND of the coaxial connector to a GND electrode which is provided at an end of a back surface of the board, evaluation of the performance is achieved on the basis of a high frequency signal which is obtained from the terminal electrode. On this occasion, in case where a structure for electrically connecting the core conductor of the coaxial connector to the terminal electrode and electrically connecting the shell GND of the coaxial connector to the GND electrode is formed by soldering work, the work is complicated. Moreover, a work for removing the coaxial connector which has been soldered and fixed, from the board is also complicated. In view of the above, a related-art relay connector in which the coaxial connector can be attached to the board, without soldering has been already proposed (refer to JP-A-2008-171801).

The related-art relay connector disclosed in JP-A-2008-171801 will be briefly described referring to FIGS. 9A to 11. FIGS. 9A, 9B and 9C are views showing an outer appearance of the related-art relay connector. FIG. 9A is a side view, FIG. 9B is a plan view, and FIG. 9C is a front view. FIG. 10 is a sectional view as seen from arrow marks A-A in FIG. 9B. FIG. 11 is an exploded perspective view of the relay connector as shown in FIGS. 9A to 9C. In the related-art relay connector as shown in FIGS. 9A to 11, a through hole 20*a* is provided in a main block 20 formed of conductive material, a dielectric member 22*b* projected from a shell GND 22*a* of a coaxial connector (an SMA connector, for example) 22 is inserted into the through hole 20*a* from a back surface, the shell GND 22*a* is fixed with screws to the back surface to be electrically connected, and further, a core conductor 22*c* which has come out by stripping off the dielectric member 22*b* is projected from a front surface of the main block 20. On this occasion, an end surface of the dielectric member 22*b* is at a substantially same position as the front surface of the main block 20 or at a slightly retreated position from the front surface. Moreover, an axial direction in which the core conductor 22*c* is projected is perpendicular to the front surface of the main block 20. Guide pins 24, 24 are uprightly provided in the main block 20 so as to extend downward, in parallel with the front surface of the main block 20. A GND block 26 formed of conductive material is provided with guide boles 26*a*, 26*a* into which the guide pins 24, 24 are inserted. By detachably inserting the guide pins 24, 24 into these guide holes 26*a*, 26*a*, the GND block 26 can relatively move with respect to the main block 20 in sliding contact with each other, in a linear direction parallel to the front surface of the main block 20. Further, the GND block 26 is provided with a board rest part 26*b* so as to be opposed to the core conductor 22*c* in such a manner that the board rest part 26*b* can move in a direction of approaching or separating from the core conductor 22*c* by the relative movement. Moreover, an insulating cover is provided on a surface of the main block 20 in contact with the core conductor 22*c* at an opposite side to the board rest part 26*b*, so that the core conductor may not be bent, when the board is clamped between the board rest part 26*b* and the core conductor 22*c*.

Further, moving range regulating screws 32, 32 are passed through moving range regulating through holes 30*a*, 30*a* which are formed in a vertical direction in an operating member 30, so as to move within a determined range in an axial direction. Then, distal ends of the moving range regulating screws 32, 32 are screwed into the main block 20 at an opposite side to a position where the GND block 26 is provided with respect to the core conductor 22*c*, and erected, in such a manner that the operating member 30 can relatively move in a direction of approaching or separating from the main block 20 within a determined range. On this occasion, a direction of the GND block 26 approaching or separating from the core conductor 22*c* and a direction of the operating member 30 approaching or separating from the main block are parallel to each other. In addition, elastic springs 34, 34 as elastic members are provided in a contracted state between the operating member 30 and the main block 20, whereby the operating member 30 is elastically urged in a direction of separating from the main block 20. Still further, the operating member 30 and the GND block 26 are connected to each other by means of connecting members 38, 36 with connecting pins 36, 36. These connecting members 38, 38 allow the GND block 26 to move in a direction of approaching or separating with respect to the core conductor 22*c* in association with the movement of the operating member 30 in the approaching or separating direction. Still further, a leaf spring 40 having conductivity is fixed to the GND block 26 with small screws. The leaf spring 40 is slidably provided in elastic contact with the main block 20, and electrically connected thereto. It is to be noted that a lateral width W of the related-art relay connector is set to be 12.7 mm, for example, which is equal to the lateral width of the shell GND 22*a*.

In the related-art relay connector disclosed in JP-A-2008-171801, the board is inserted between the core conductor 22*c* and the board rest part 26*b*, by enlarging a distance between the core conductor 22*c* and the board rest part 26*b* by the relative movement of the main block 20 and the GND block 26, and the board can be clamped between the core conductor 22*c* and the board rest part 26*b* by reducing the distance between them by the relative movement. Then, the core conductor 22*c* of the coaxial connector 22 is brought into contact with a terminal electrode provided on a surface of the board to be electrically connected, and a GND electrode provided on a back surface of the board is electrically connected to the shell GND 22*a* of the coaxial connector 22 by way of the GND block 26 having the board rest part 26*b* and the main block 20. In this manner, it is possible to easily electrically connect the board to the coaxial connector 22. Moreover, it is possible to easily detach the board which has been inserted between the core conductor 22*c* and the board rest part 26*b*, by enlarging the distance between them by the relative movement. The work is extremely easily done, because when the operating member 30 is pressed to move toward the main block 20 against elastic forces of the elastic members 34, 34, the board rest part 26*b* of the GND block 26 which is connected to the operating member 30 by means of the connecting members 38, 38 relatively moves in a direction of separating from the core conductor 22*c*, and the distance between the core conductor 22*c* and the board rest part 26*b* is enlarged, whereby the board can be inserted between them, and further, when the pressure on the operating member is released, the board can be clamped between the core conductor 22*c* and the board rest part 26*b* with the elastic forces.

The related-art relay connector disclosed in JP-A-2008-171801 as described above is excellent in that the coaxial connecter 22 can be electrically connected to the board through the simple work. However, the dielectric member 22*b* of the coaxial connector 22 to be inserted into the through hole 22*a* which is provided in the main block 20 is fairly long, and a slight gap is likely to occur between an inner peripheral surface of the through hole 22*a* and an outer peripheral surface of the dielectric member 22*b*. Consequently, there is such anxiety that constant impedance is not maintained between them. Moreover, a slight gap may occur also between the main block 20 and the shell GND 22*a* of the coaxial connector 22 which is fixed to the main block 20, in some cases, and continuity of the impedance is likely to be lost due to the gap too. As the results, a slight deterioration of characteristic value in a part of a frequency zone is observed in the related-art structure, as compared with the conventional structure in which the core conductor of the coaxial connector is electrically connected to the terminal electrode by soldering, and the shell GND of the coaxial connector is electrically connected to the GND electrode by soldering.

SUMMARY

It is therefore an object of the invention to provide a relay connector in which a work for electrically connecting a core conductor of a coaxial connector to a terminal electrode, and a work for electrically connecting a shell GND of the coaxial connector to a GND electrode are simply done, and in which characteristic value is not deteriorated in an entire frequency zone.

In order to achieve the object, according to the invention, there is provided a relay connector in which a core conductor of a coaxial connector is electrically connected to a terminal electrode which is provided at an end of a surface of a board, and a shell GND of the coaxial connector is electrically connected to a GND electrode which is provided at an end of a back surface of the board, the shell GND having a substantially columnar outer shape, the relay connector comprising:

a conductive first block having a first surface and a second surface being opposite to the first surface, the first block formed with a through hole, the coaxial connector being provided in the through hole, a part of the shell GND being provided in the through hole, the core conductor of the coaxial connector being projected from the first surface of the first block; and a conductive second block provided with a board rest part on which the board is to be placed, the second block operable to relatively move with respect to the first block and being electrically connected to the first block.

The relay connector may further comprise: a third block; a shaft extending in a direction perpendicular to an axial direction of the coaxial connector and passing through the second block, the shaft one end of which is fixed to the first block and the other end of which is fixed to the third block; an elastic member provided between the first block and the third block; a connecting member operable to relatively move with respect to the first block in a direction parallel to the shaft and fixed to the second block; and an operating member fixed to the connecting member and provided at an opposite side to the second block with respect to the first block. The coaxial connector may be a spark plug type, the shell GND may cover a dielectric member, a screw may be formed on an outer peripheral surface of the shell GND, the core conductor may be stripped off from the dielectric member, and a part of the shell GND of the coaxial connector may be projected from the second surface of the first block. When the operating member is pressed to move toward the first block, the second block moves in a direction of separating from the first block against an elastic force of the elastic member so that the board rest part relatively moves in a direction of separating from the core conductor, whereby a distance between the core conductor and the board rest part is enlarged for enabling the board to be inserted between the core conductor and the board rest part. When a pressure on the operating member is released, the second block moves to approach the first block with an elastic force of the elastic member, whereby the board, inserted between the core conductor and the board rest part, is clamped between the core conductor and the board rest part.

The first block may have a third surface and a fourth surface being opposite to the third surface, which are connected to the first and second surfaces. The connecting member may include two connecting members provided on the third and fourth surfaces. The first block and the third block may be fixed to frame bodies which are arranged outside the connecting members. The connecting members can move between the first block and the frame bodies. An operating lever may be swingably provided on the frame bodies, at an opposite side to the first block with respect to the operating member. Along with swinging operation of the operating lever, the operating member may be pressed to move toward the first block or the pressure on the operating member may be released by means of a cam part provided on the operating lever.

The connecting members may be formed with elongated holes each of which extends in a direction parallel to the shaft and has a length. The first block may be provided with projected parts to be engaged with the elongated holes, at the third and fourth surfaces. Each of the projected parts may include two projections which are provided at a shorter interval than the length, or a rib which is shorter than the length.

A conductive surface GND rest part may be provided on the first surface of the first block at an opposite side to the second block with respect to the core conductor and have a surface opposed to the board rest part of the second block and a recess for avoiding a contact with the core conductor. The surface of the surface GND rest part may be parallel to the board rest part and be positioned slightly apart from a position where the core conductor is closest to the board rest part. When the board is clamped between the core conductor and the board rest part, the core conductor is slightly slackened to be elastically in contact with the terminal electrode of the board and the surface GND rest part is elastically in contact with the GND electrode of the board.

BRIEF DESCRIPTION OF THE DRAWINGS

FIG. 1A is a side view, FIG. 1B is a plan view, and FIG. 1C is a front view.

FIG. 3A shows a state where the operating lever is laterally tilted to clamp a board, and FIG. 3B shows a state where the operating lever is erected so that the board can be inserted.

FIG. 4A shows a state where the operating lever is laterally tilted to clamp the board, and FIG. 4B shows a state where the operating lever is erected so that the board can be inserted.

FIG. 5A shows a state where the operating lever is laterally tilted to clamp the board, and FIG. 5B shows a state where the operating lever is erected so that the board can be inserted.

FIG. 8A is a perspective view of the outer appearance, and FIG. 8B is a view as seen from an arrow mark A in FIG. 8A.

FIG. 9A is a side view, FIG. 9B is a plan view, and FIG. 9C is a front view.

DETAILED DESCRIPTION OF EMBODIMENTS

Figure 1B:
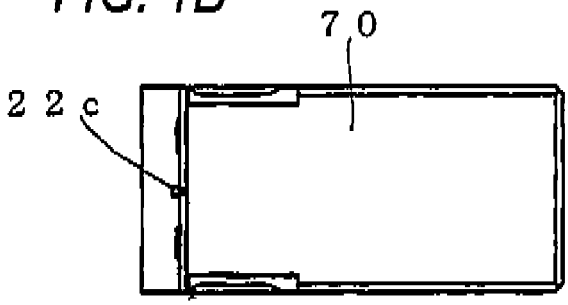
FIGS. 1A, 1B, 1C are views showing an outer appearance of a relay connector in the first embodiment according to the invention.
Figure 1C:
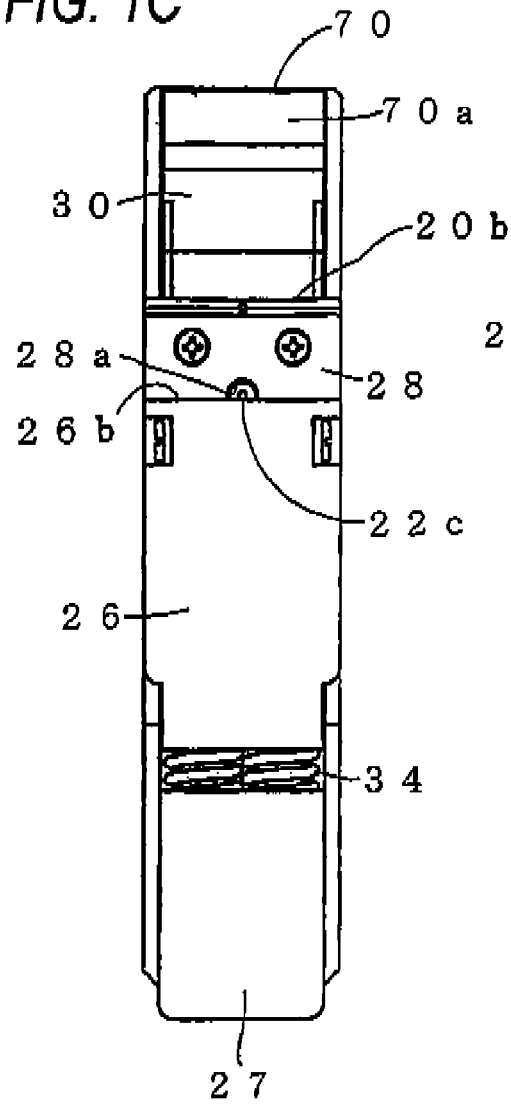
Figure 1A:
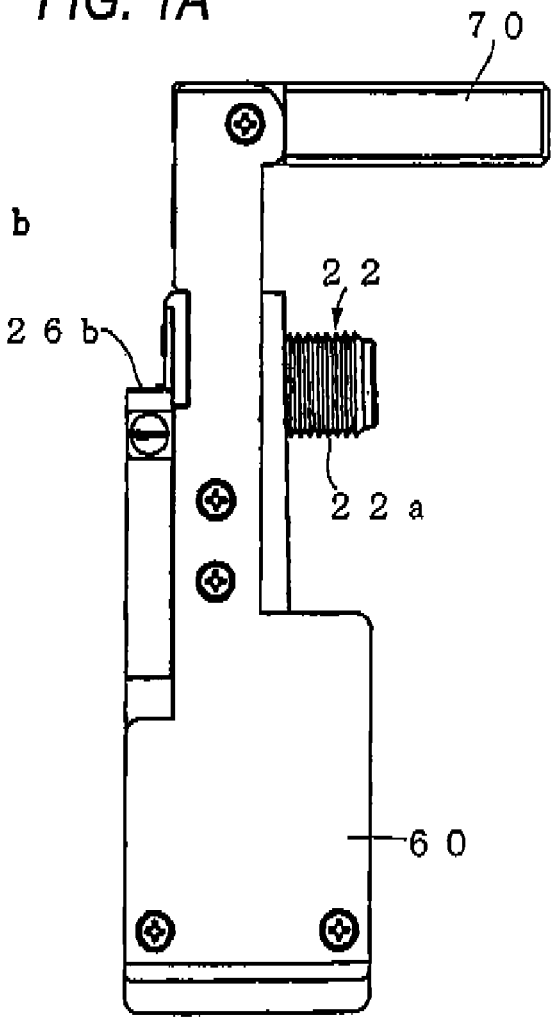
Figure 2:
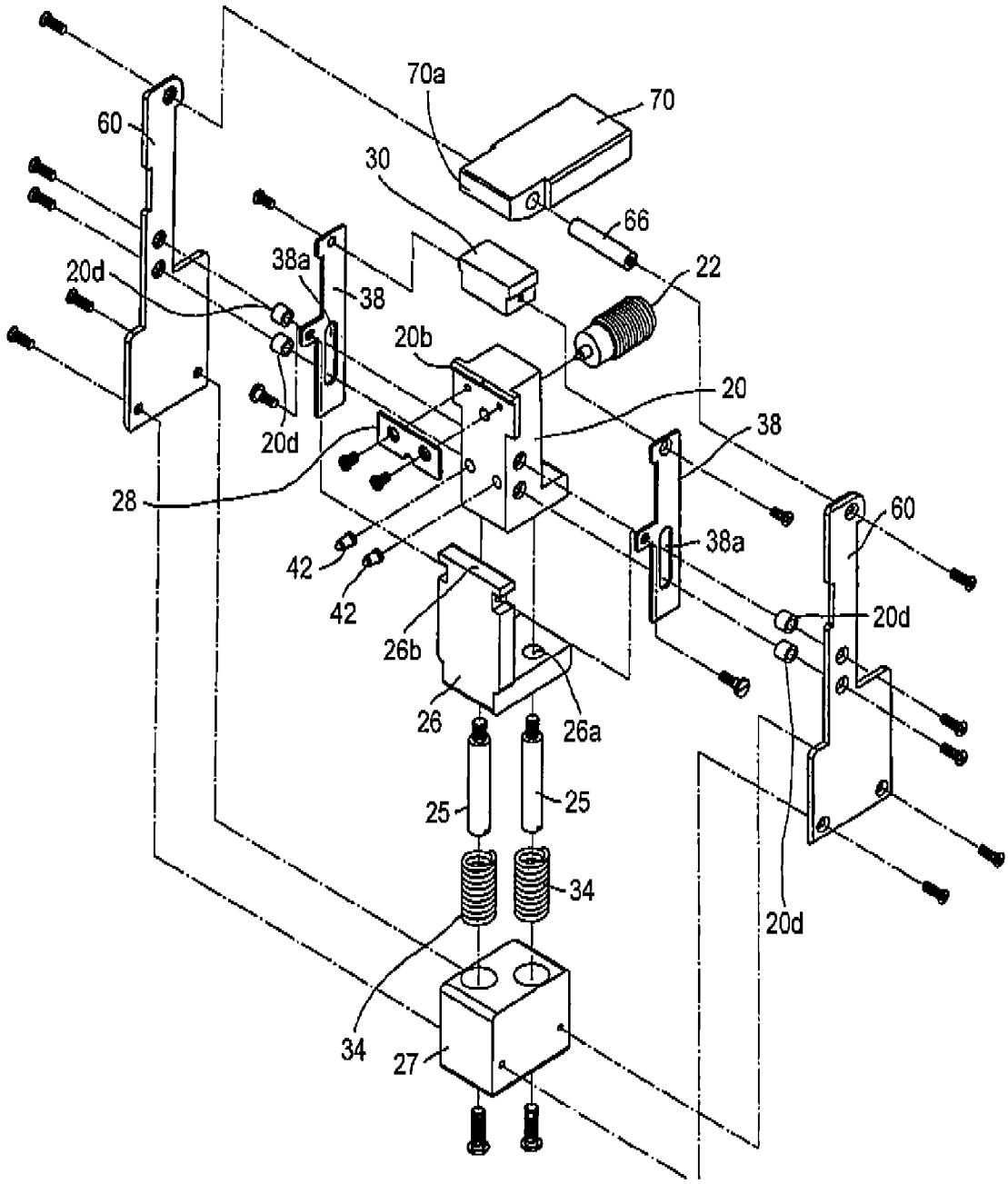
FIG. 2 is an exploded perspective view of the relay connector in FIGS. 1A to 1C.

Now, a first embodiment of the invention will be described referring to FIGS. 1A to 8B. In FIGS. 1A to 8B, those members equal to or equivalent to the members as shown in FIGS. 9A to 11 are denoted with the same reference numerals, and overlapped descriptions will be omitted.

Figure 5B:
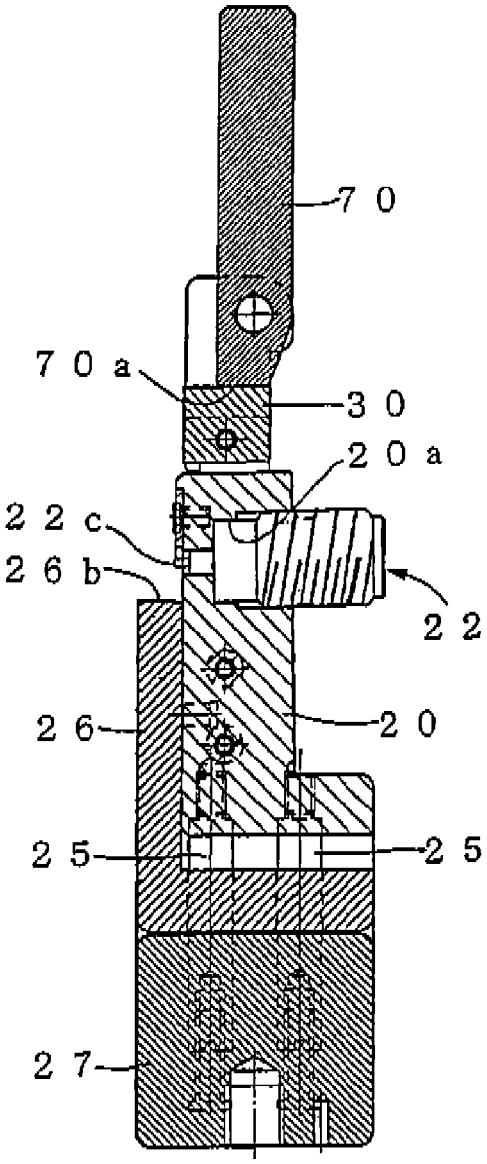
FIGS. 5A and 5B are vertical sectional views in a state where the operating lever is swung.
Figure 5A:
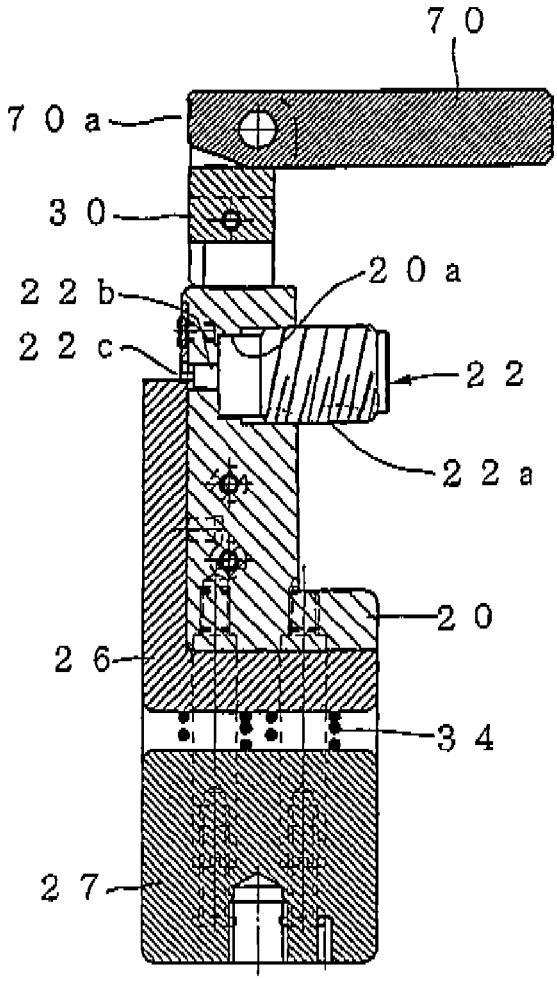
Figure 6:
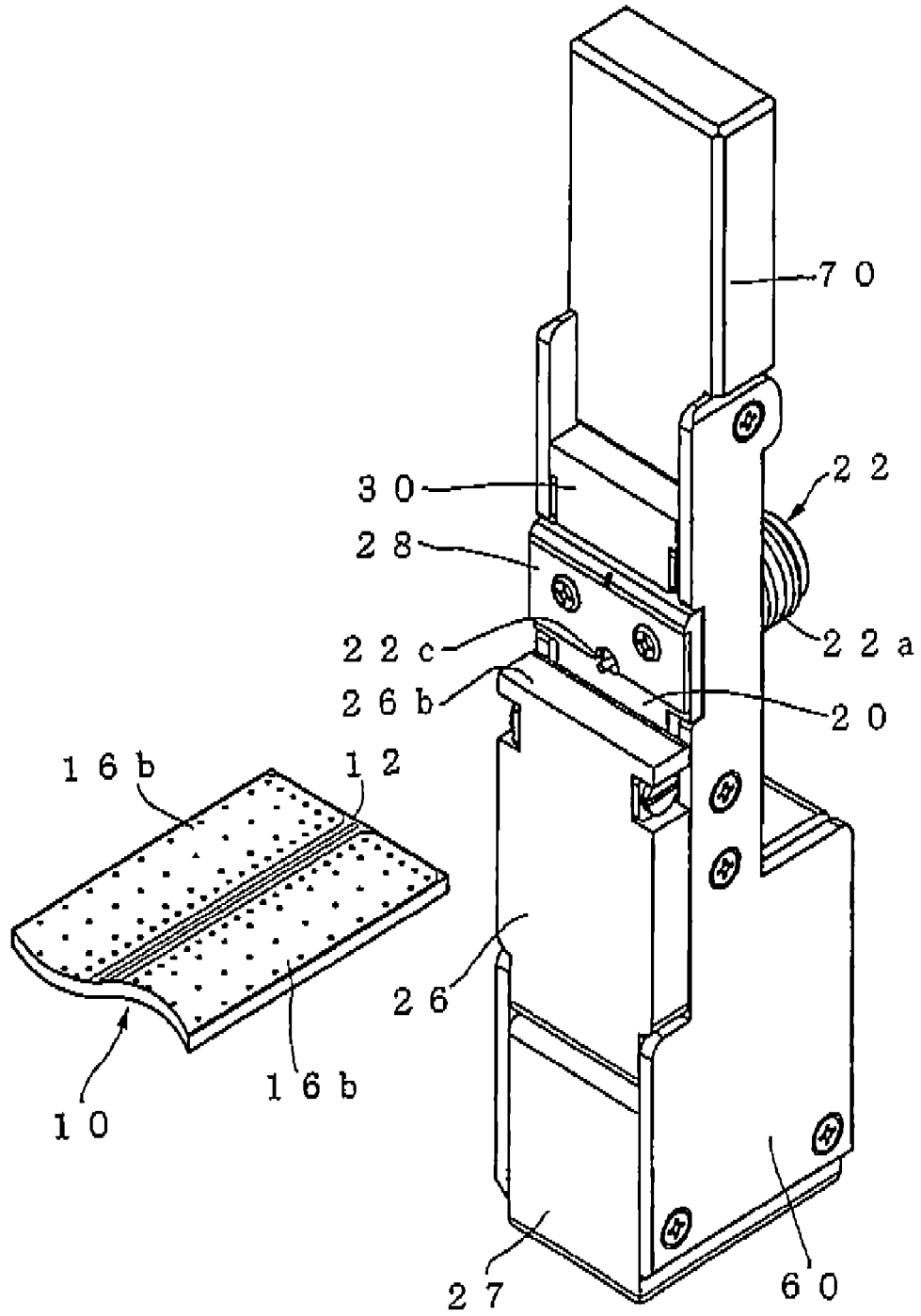
FIG. 6 is a perspective view showing the outer appearance of the relay connector in the first embodiment of the invention into which the board is to be inserted.
Figure 7:
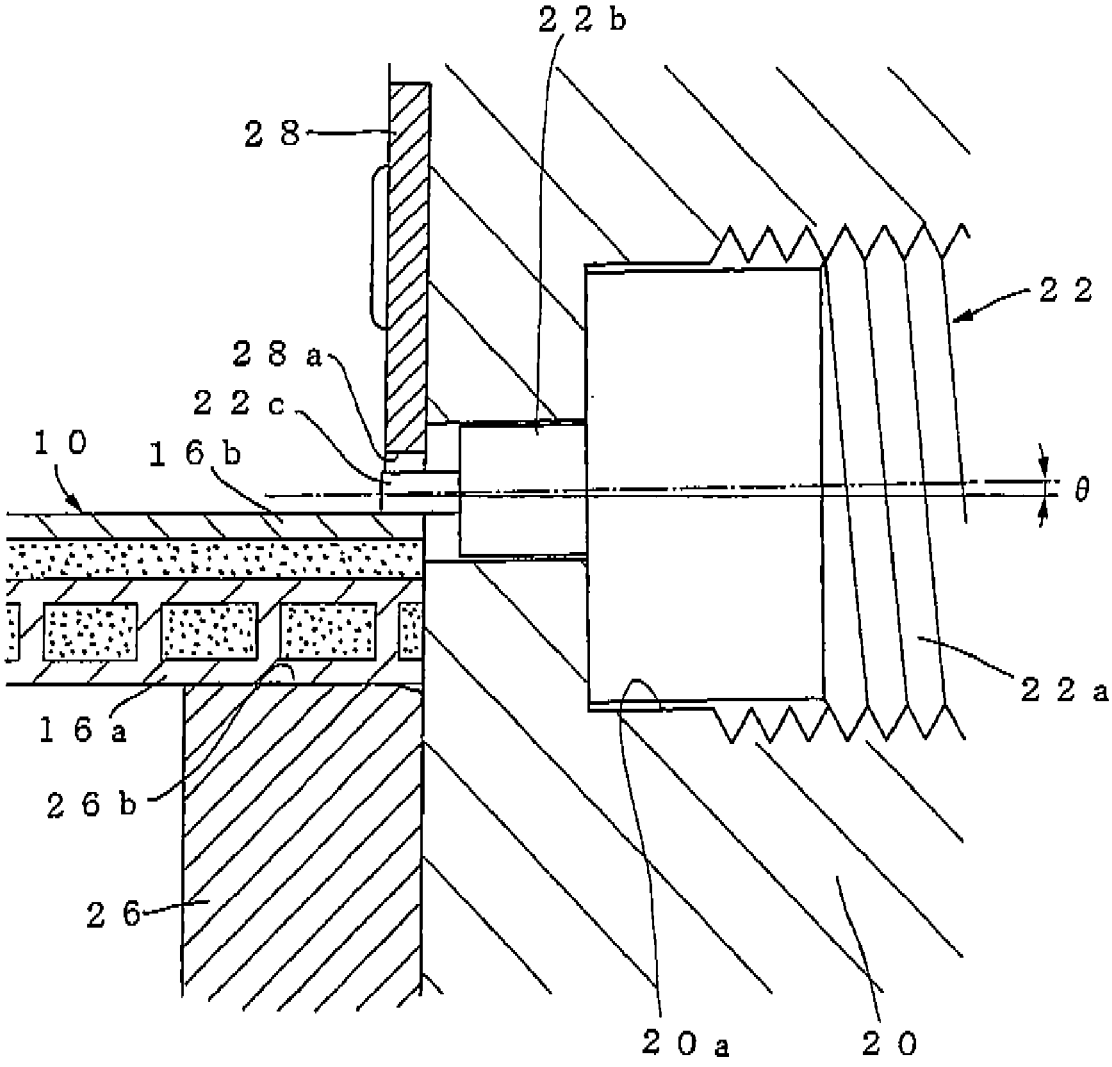
FIG. 7 is a vertical sectional view showing a structure in which a core conductor is projected from a main block in a state where the board is not clamped.

Referring to FIGS. 1A to 7, in the first embodiment of the relay connector according to the invention, a relay connector of a spark plug type is used as a coaxial connector 22. In this type of connector, a shell GND 22*a* at an earth side has a substantially columnar outer shape having a screw formed on an outer peripheral surface thereof, and the shell GND 22*a* covers a dielectric member 22*b* up to a position near a core conductor 22*c* which has come out by stripping off the dielectric member 22*b*. A main block 20 formed of conductive material is provided with a through hole 20*a*, and a female screw is appropriately formed in the through hole 20*a*. The shell GND 22*a* of the coaxial connector 22 is spirally inserted into the through hole 20*a* from a back surface side to be fixed in a state where a back end portion of the shell GND 22*a* is projected from the back surface of the main block 20, and at the same time, electrically connected to the main block 20. Then, the core conductor 22*c* which has come out by stripping off the dielectric member 22*b* is projected from a surface side of the main block 20. In this state, an end surface of the dielectric member 22*b* is not projected from the surface side of the main block 20. Moreover, an axial direction in which the core conductor 22*c* is projected is substantially perpendicular to the surface of the main block 20, but provided in such a manner that a distal end portion thereof is slightly inclined downward at an angle θ, as shown in FIG. 7. Respective one ends of shafts 25, 25 are spirally fixed to a lower surface of the main block 20 in a direction parallel to the surface. A GND block 26 formed of conductive material is provided with guide holes 26*a*, 26*a* into which the shafts 25, 25 are inserted. By inserting the shafts 25, 25 into these guide holes 26*a*, 26*a* so as to freely move, the GND block 26 is so constructed as to relatively move with respect to the main block 20 in sliding contact in a linear direction parallel to the surface. Moreover, spring connectors 42, 42 are embedded in a sliding contact surface of the main block 20 with respect to the GND block 26, and elastically contacted with a sliding contact surface of the GND block 26 thereby to achieve electrical connection between the main block 20 and the GND block 26. Further, the GND block 26 is provided with a board rest part 26*b* so as to be opposed to the core conductor 22*c*, in such a manner that the board rest part 26*b* can move in a direction of approaching or separating from the core conductor 22*c* by relative movement. Moreover, a surface GND rest part 28 formed of conductive material is fixed with screws to the surface of the main block 20 at an opposite side to the board rest part 26*b* in the direction of approaching or separating from the board rest part 26*b*. An upper surface and a lower surface of this surface GND rest part 28 are formed in parallel with each other, and a recess 28*a* in a semicircular shape is formed on the lower surface so that the lower surface may not come into contact with the core conductor 22*c* and may not be electrically connected. Further, a positioning protuberance 20*b* of which a lower surface is parallel to the board rest part 26*b* is provided on the surface of the main block 20, at an upper side where the surface GND rest part 28 is fixed. Therefore, position and posture of the surface GND rest part 28 are regulated, by abutting the upper surface thereof against the lower surface of the positioning protuberance 20*b*, whereby the lower surface of the surface GND rest part 28 can be fixed to the surface of the main block 20 in parallel with the board rest part 26*b*. In addition, the lower surface of the surface GND rest part 28 is set to be at a slightly upper position than a position of a lower end of the distal end portion of the core conductor 22*c* which is projected from the main block 20 in a substantially perpendicular direction, but slightly inclined downward at the angle θ at the distal end portion.

Further, the other ends of the shafts 25, 25 are fixed to a base block 27. The GND block 26 is arranged between the main block 20 and the base block 27, and can move in an axial direction of the shafts 25, 25 within a determined range between them. Further, elastic springs 34, 34 as elastic members are provided between the base block 27 and the GND block 26 in a contracted state so as to be idly fitted to the shafts 25, 25. In this manner, the GND block 26 is elastically urged toward the main block 20. In addition, connecting members 38, 38 are provided on both side surfaces of the main block 20 so as to move within a determined range in a direction parallel to the shafts 25, 25. For example, the connecting members 38, 38 are provided with elongated holes 38*a*, 38*a* which are longer in a direction parallel to the shafts 25, 25, while the main block 20 is provided with projected parts including projections to which two collars 20*d*, 20*d* are fixed at a shorter interval than a length of the elongated holes 38*a*, 38*a* in a direction parallel to the shafts 25, 25, and the projected parts are engaged with the elongated holes 38*a*, 38*a*. It is also possible to form the projected parts by respectively providing ribs having a shorter length than a length of the elongated holes 38*a*, 38*a* in the direction parallel to the shafts 25, 25, on both the side surfaces of the main block 20. Then, the connecting members 38, 38 are fixed to the GND block 26 with screws or the like, and further, fixed to an operating member 30 with screws or the like, at a position separated above from the main block 20, at an opposite side to the GND block 26 with respect to the main block 20. In this embodiment, a distance between the main block 20 and the operating member 30 is set to be substantially equal to a distance in which the GND block 26 can move between the main block 20 and the base block 27.

Further, frame bodies 60, 60 formed of sheet metal are arranged on both the side surfaces of the main block 20, outside the connecting members 38, 38, and fixed with screws to the main block 20 and the base block 27. It is also possible to fix the frame bodies 60, 60 to the main block 20 by tightening them together with the collars 20*d*, 20*d* of the projected parts which are provided on both the side surfaces of the main block 20. In this embodiment, a width of the relay connector, in a state where the frame bodies 60, 60 are provided on both the side surfaces of the main block 20, is preferably set to be the same size as the lateral width of the shell GND 22*a* of the related-art coaxial connector 22 of the SMA type, that is, 12.7 mm, for example, or a smaller size than that. Upper ends of the frame bodies 60, 60 at both sides are extended above the operating member 30, and an operating lever 70 is mounted so as to freely swing around a swinging support shaft 66 which is provided at upper end portions of the frame bodies 60, 60 perpendicularly to an operating and moving direction of the operating member 30. This operating lever 70 is provided with a cam part 70*a* opposed to the operating member 30. By swinging the operating member 70 between an erected state and a laterally tilted state, the operating member 30 can be pressed downward, or released from the pressed state.

Figure 3B:
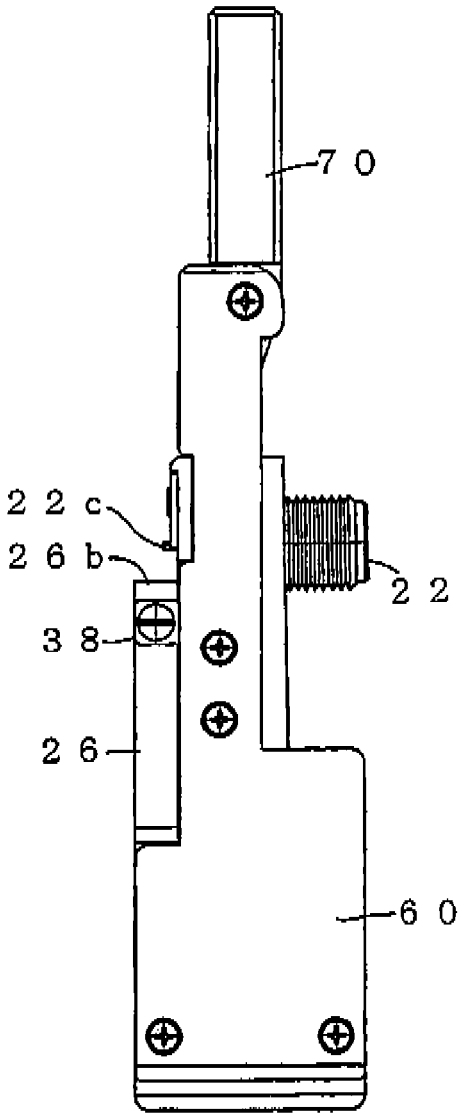
FIGS. 3A and 3B are side views of the relay connector in FIGS. 1A to 1C in a state where an operating lever is swung.
Figure 3A:
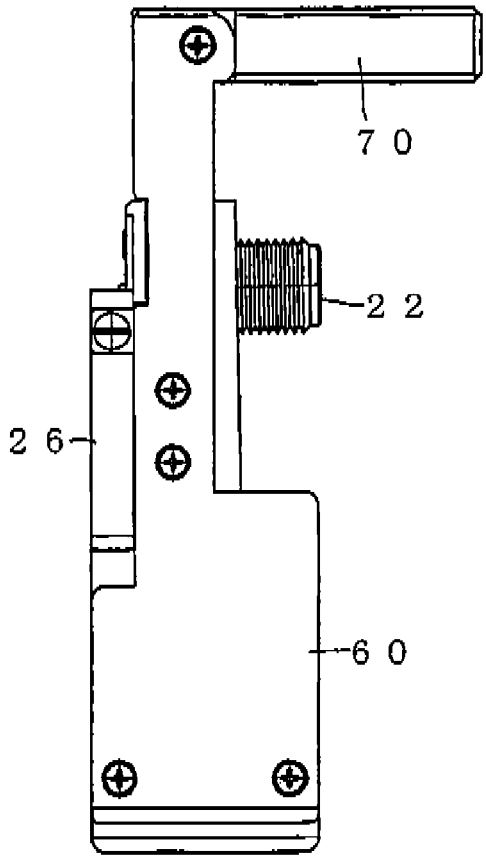
Figure 4B:
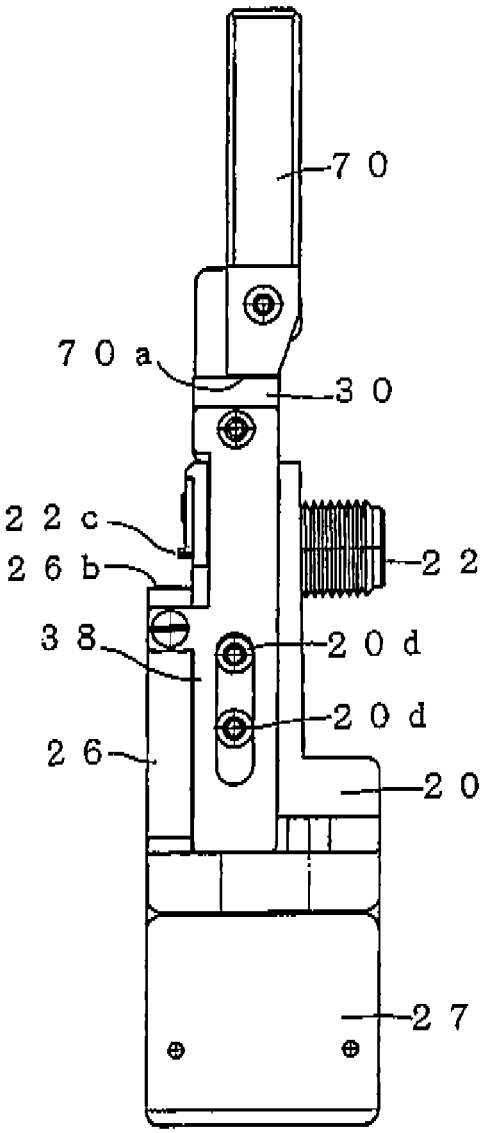
FIGS. 4A and 4B are side views of the relay connector in a state where a frame body which is provided on a side surface in FIGS. 3A and 3B is removed and the operating lever is swung.
Figure 4A:
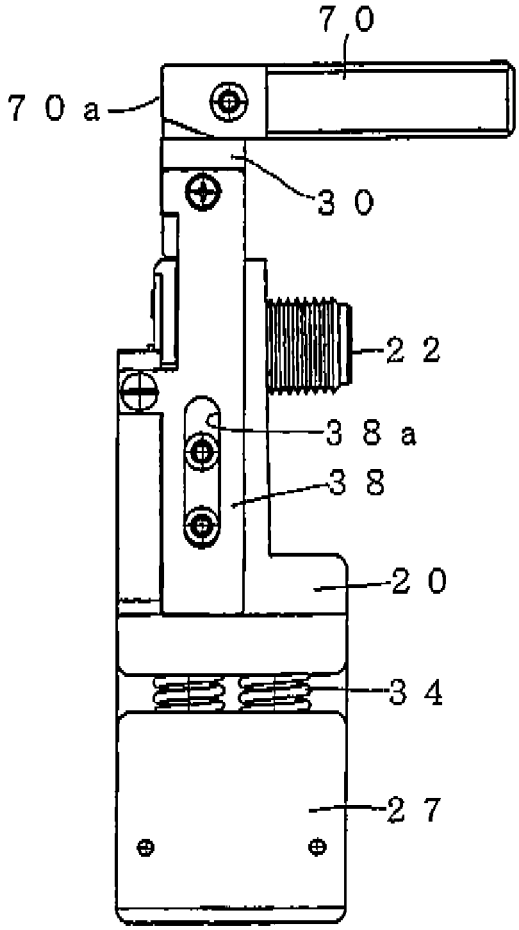

In the above described structure, as shown in FIGS. 3B, 4B, 5B, in a state where the operating lever 70 is erected, the cam part 70*a* is brought into contact with the operating member 30 thereby to press the operating member 30 in a direction of approaching the main block 20. Then, the GND block 26 which is connected by means of the connecting members 38, 38 are relatively moved with respect to the main block 20 against elastic forces of the elastic springs 34, 34, and the board rest part 26*b* is moved in a direction of separating from the core conductor 22*c*, thereby to enlarge a distance between the board rest part 26*b* and the core conductor 22*c*. In this state, a board 10 is positioned and inserted between the core conductor 22*c* and the board rest part 26*b*, as shown in FIG. 6. On the other hand, as shown in FIGS. 3A, 4A, 5A, in a state where the operating lever 70 is laterally tilted, the pressed state of the operating member 30 is released, and the operating member 30 can be moved in a direction of separating from the main block 20. Following this movement, the GND block 26 is moved toward the main block 20 with the elastic forces of the elastic springs 34, 34, and the board rest part 26*b* is moved in a direction of approaching the core conductor 22*c*. In this manner, it is possible to clamp the board 10 between the core conductor 22*c* and the board rest part 26*b*. On occasion of inserting the board 10, it is possible to easily position the board 10 with respect to the core conductor 22*c*, by arranging a terminal electrode 12 which is provided at an end of the surface, so as to be opposed to the distal end portion of the core conductor 22*c*. When the board 10 has been clamped, the terminal electrode 12 comes into contact with the core conductor 22*c* to be electrically connected, and a GND electrode 16*a* at an end of the back surface of the board 10 is electrically connected to the shell GND 22*a* by way of the GND block 26 having the board rest part 26*b* and the main block 20 in series. In this manner, the terminal electrode 12 of the board 10 and the GND electrode 16*a* at the end of the back surface of the board 10 are electrically connected to the coaxial connector 22.

By the way, recently, there are some boards 10 which are provided with GND electrodes 16*b* on their surfaces. It is of course impossible to electrically connect the board rest part 26*b* of the GND block 26 to the GND electrodes 16*b* on the surface of the board 10 of this type. Therefore, the surface GND rest part 28 formed of conductive material is fixed with screws to the surface of the main block 20 at an opposite side to the board rest part 26*b* with respect to the core conductor 22*c*, so that the surface GND rest part 28 may be brought into contact with the GND electrodes 16*b* which are provided on the surface of the board 10 to be electrically connected. On this occasion, the board 10 is clamped between the board rest part 26*b* and the surface GND rest part 28. In order to clamp the board equally, a surface of the board rest part 26*b* adapted to come into contact with the board 10 and a surface of the surface GND rest part 28 adapted to come into contact with the board 10 must be exactly parallel to each other. Moreover, the surface GND rest part 28 must be exchanged according to positions of the GND electrodes 16*b* on the surface of the board 10. Therefore, the surface GND rest part 28 is fixed with the screws so that it can be easily exchanged, and its posture in a fixed state is regulated by the positioning protuberance 20*b* which is provided on the main block 20, whereby the lower surface of the surface GND rest part 28 can be made parallel to the board rest part 26*b*. A diameter of the recess 28*a* in a semicircular shape which is provided in the surface GND rest part 28 must be at least twice as large as a width of the terminal electrode 12 so that both the core conductor 22*c* and the surface GND rest part 28 may not come into contact with the terminal electrode 12 of the board 10, even though the board 10 is displaced. Moreover, the diameter of the recess 28*a* is set to be equal to the distance between the GND electrodes 16*b*, 16*b* which are provided at both sides of the terminal electrode 12 on the surface of the board 10 or slightly larger than the distance, as shown in FIG. 6. Further, it is desirable that a thickness of the surface GND rest part 28 is as small as possible considering electrical performance, so that an impedance of a signal path can be maintained to be as close as possible to 50Ω. Although the thickness may be appropriately designed, considering a case where the GND electrodes 16*b*, 16*b* are set back from the end of the board when they are formed, and mechanical strength, the thickness of about 0.2 mm or more would be desirable. Because this surface GND rest part 28 is provided, it is possible to deal with the board 10 which is provided with the GND electrodes 16*b*, 16*b* on the surface, and also possible to deal with the board 10 which is provided with the GND electrodes 16*a*, 16*b*, 16*b* together on the back surface and on the surface.

The axial direction in which the core conductor 22*c* is projected is slightly inclined downward at the distal end side at the angle θ with respect to the surface of the main block 20, as shown in FIG. 7, and the lower surface of the surface GND test part 28 is set to be at a slightly upper position than the lower end of the distal end portion of the core conductor 22*c*. Therefore, when the core conductor 22*c* is elastically contacted with the terminal electrode 12 of the board 10, the lower side of the distal end portion of the core conductor 22*c* is first brought into contact with the terminal electrode 12, then, following this contact, the core conductor 22*c* is elastically deformed so as to extend along the terminal electrode 12 in elastic contact therewith, and thereafter, the surface GND rest part 28 comes into contact with the GND electrodes 16*b*, 16*b* on the surface of the board 10. The lowermost end portion of the core conductor 22*c* is set to be at a lower position than the lower surface of the surface GND rest part 28, for example, by several ten microns. In this manner, the core conductor 22*c* and the surface GND rest part 28 are respectively brought into contact with the terminal electrode 12 and the GND electrodes 16*b*, 16*b*, utilizing elastic deformation of the core conductor 22*c*, whereby electrical connection between them can be achieved.

In the relay connector according to the invention, the coaxial connector of the spark plug type, in which the shell GND 22*a* has a substantially columnar outer shape having the screw formed on the outer peripheral surface thereof, and the shell GND 22*a* covers the dielectric member 22*b* up to a position near the core conductor 22*c* which has come out by stripping off the dielectric member 22*b*, is used as the coaxial connector 22. As compared with the related-art structure using the coaxial connector 22 of the SMA type, the dielectric member 22*b* projecting from the shell GND 22*a* is made shorter in size. As the results, there is no anxiety that the impedance may become unstable due to the gap between the outer peripheral surface of the long-sized dielectric member 22*b* as in the related art and the inner peripheral surface of the through hole 20*a* of the main block 20. Moreover, a coaxial cable may be connected to a back end portion of the shell GND 22*a* which is projected from the back surface of the main block 20. Further, the gap between the main block 20 and the shell GND 22*a* of the coaxial connector 22 which is fixed thereto as in the related art is eliminated, and continuity of the impedance will not be lost. Therefore, as compared with the conventional structure in which the core conductor 22*c* of the coaxial connector 22 is electrically connected to the terminal electrode 12 by soldering, and the shell GND 22*a* of the coaxial connector 22 is electrically connected to the GND electrode 16 by soldering, substantially the same characteristic value can be obtained in the entire frequency zone. Further, because the electrical connection is not achieved by soldering, such complicated work that the core conductor 22*c* of the coaxial connector 22 is electrically connected to the terminal electrode 12 which is provided at the end of the surface of the board by soldering, and the shell GND 22*a* of the coaxial connector 22 is electrically connected to the GND electrode 16 which is provided at the end of the back surface of the board 10 by soldering, in the same manner as in the related-art relay connector disclosed in JP-A-2008-171801, is not required. Further, in the relay connector according to the invention, the elastic springs 34, 34 for elastically urging the board rest part 26*b* in a direction of approaching the core conductor 22*c* are arranged below the coaxial connector 22, and hence, a size of the relay connector above the core conductor 22*c* can be made shorter than in the related-art structure disclosed in JP-A-2008-171801. Consequently, when the board 10 is inserted between the core conductor 22*c* and the board rest part 26*b*, visual recognition from a diagonally upper position is enhanced.

Figure 8A:
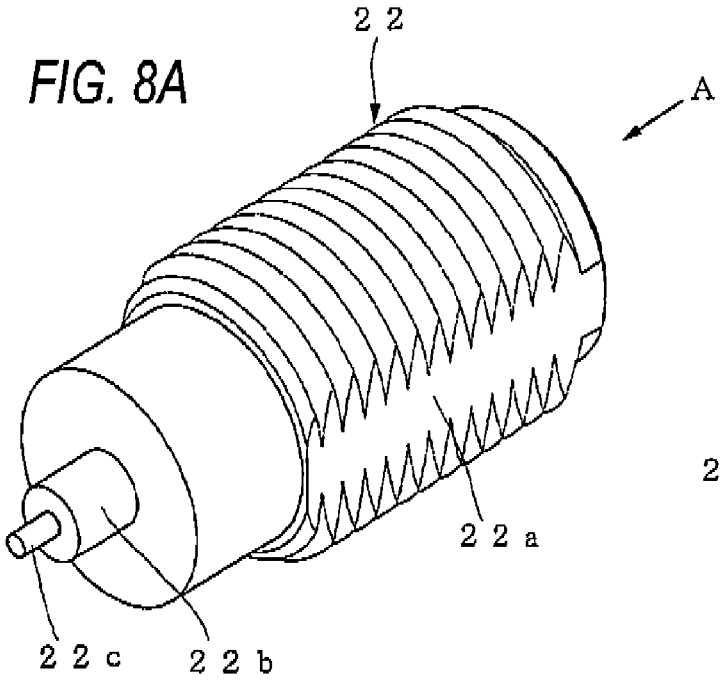
FIGS. 8A and 8B show a modification of a coaxial connector of a spark plug type which is used in the invention.
Figure 8B:
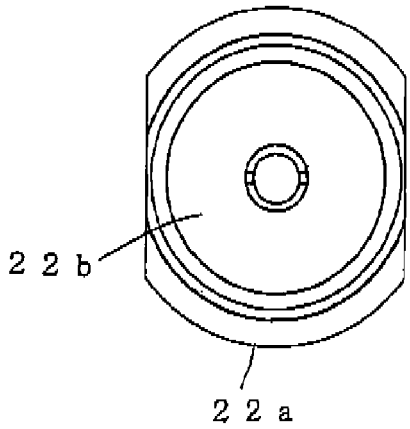
Figure 9B:
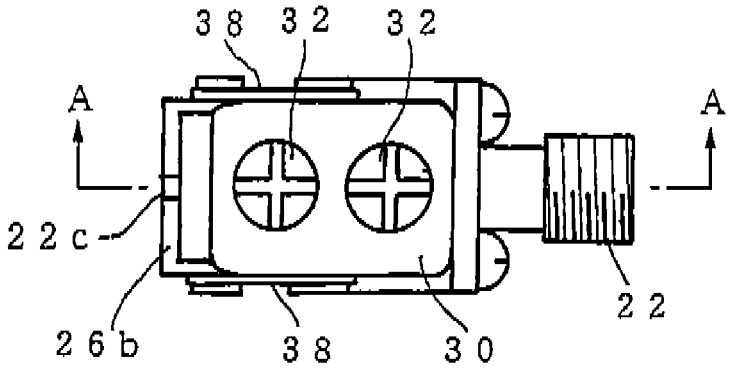
FIGS. 9A, 9B and 9C are views showing an outer appearance of the related-art relay connector.
Figure 9C:
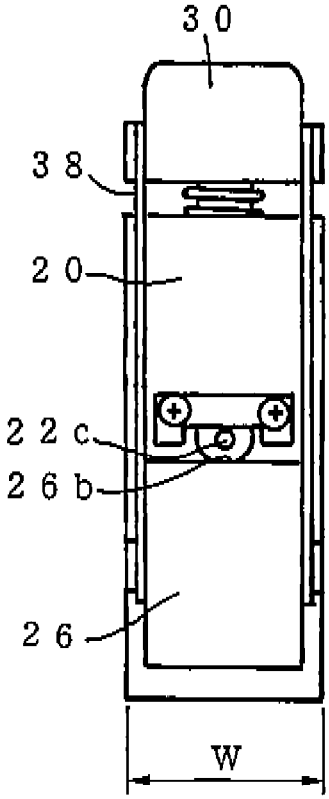
Figure 9A:
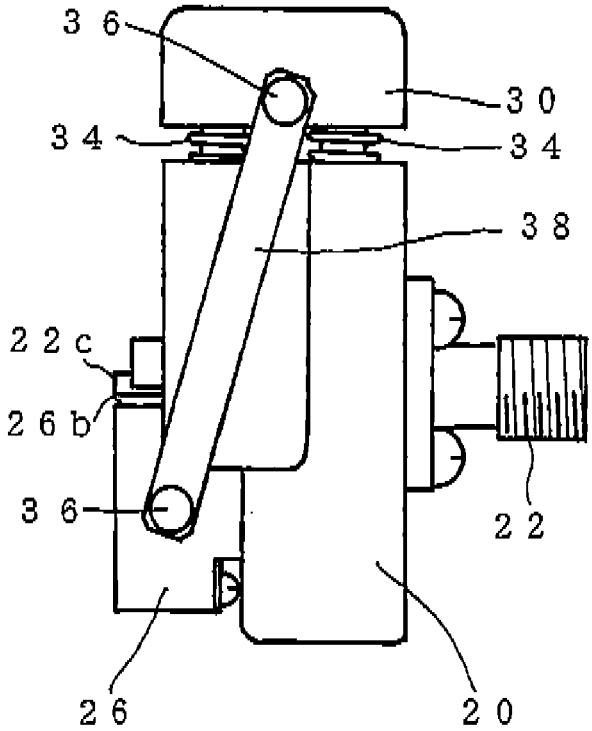
Figure 10:
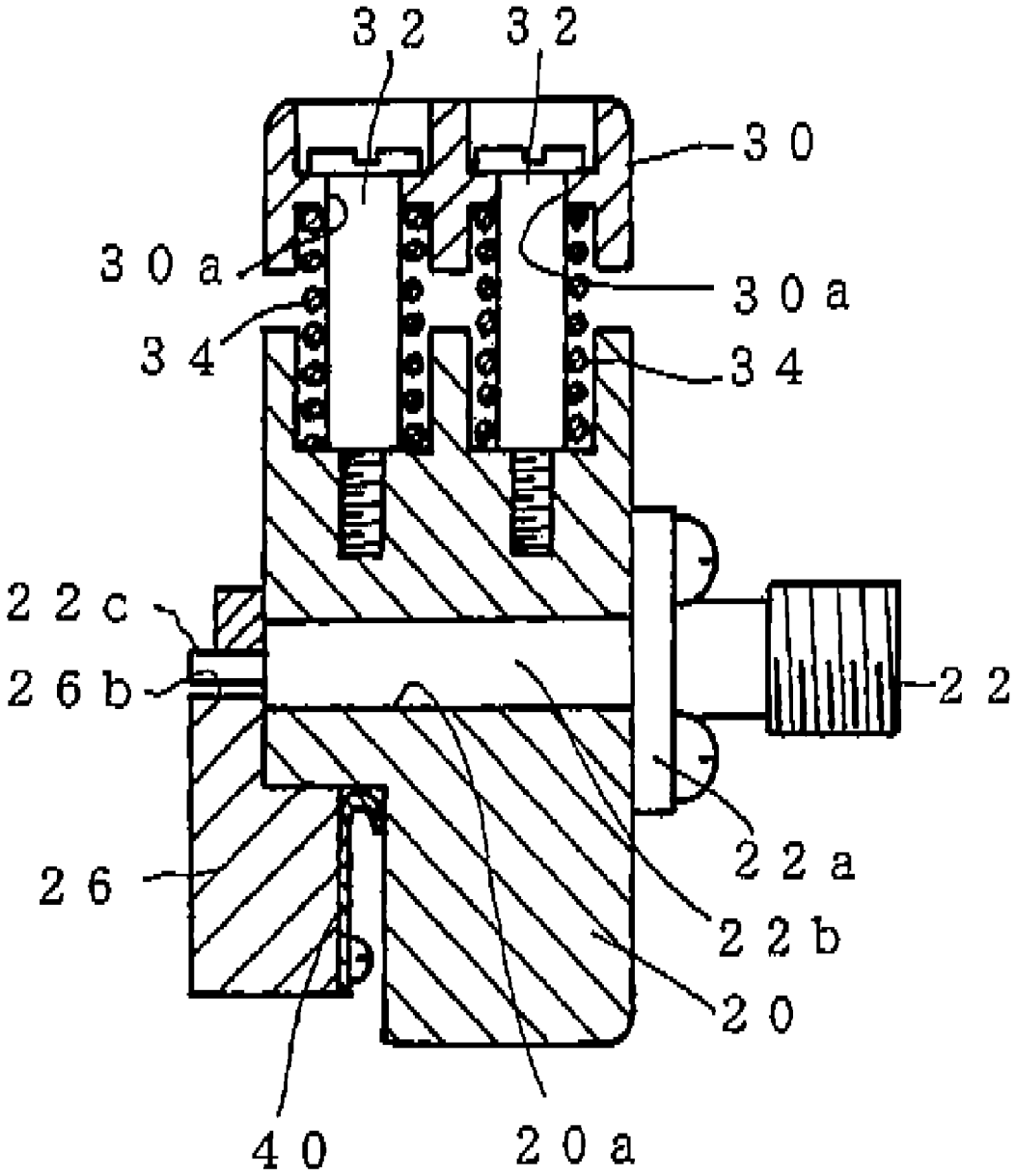
FIG. 10 is a sectional view as seen from arrow marks A-A in FIG. 9B.
Figure 11:
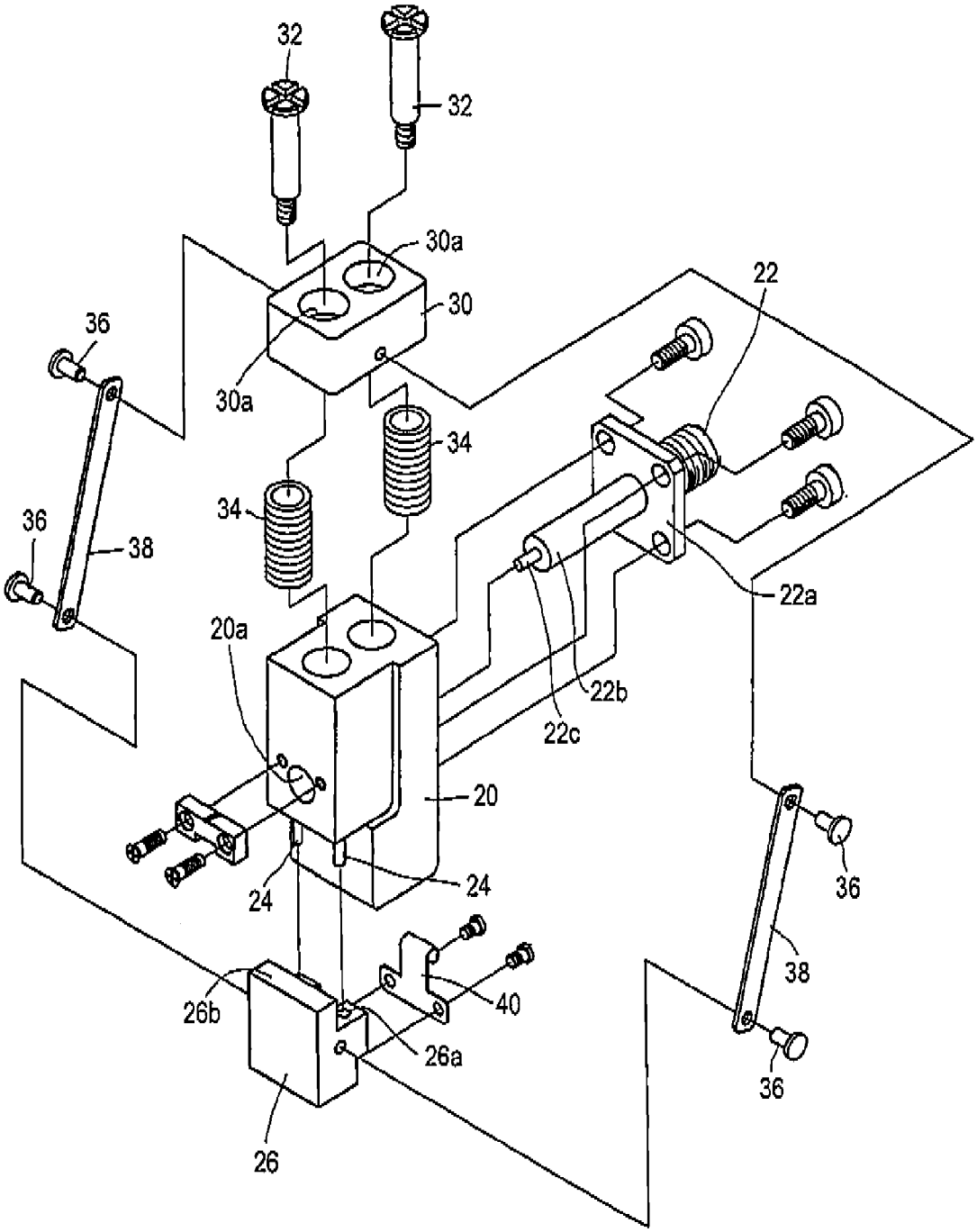
FIG. 11 is an exploded perspective view of the related-art relay connector as shown in FIGS. 9A to 9C.

In the coaxial connector 22 of the spark plug type which is used in the first embodiment of the invention, the shell GND 22*a* has the columnar outer shape and the screw is formed on its outer peripheral surface. Therefore, when the coaxial connector is spirally engaged with the through hole 20*a* of the main block 20, a particular tightening tool is necessary for fixing the coaxial connector 22 with a determined tightening torque. Considering this, the shell GND 22*a* of the coaxial connector 22 may have an oblong outer shape in cross section, as shown in FIG. 8B. In case of the oblong outer shape, it would be possible to spirally fix the coaxial connector 22 with the determined torque by a common tightening tool.

In the above described embodiment, the structure for electrically connecting the GND block 26 to the main block 20 is not limited to the structure employing the spring connectors 42, 42 as in the embodiment, but may be any other structure, provided that reliable electrical connection can be obtained. For example, the electrical connection may be achieved employing a leaf spring of conductive material or a flexible wire. Moreover, the structure for fixing the connecting members 38, 38 to both the side surfaces of the main block 20 so as to move within the determined range in a direction parallel to the shafts 25, 25 is not limited to the structure in the above described embodiment, but may be any other structure such as the structure for engaging the connecting members 38, 38 with the main block 20 by dovetail grooves.

According to an aspect of the invention, the coaxial connector of the spark plug type, in which the shell GND has the substantially columnar outer shape having the screw formed on the outer peripheral surface thereof, and the shell GND covers the dielectric member up to a position near the core conductor which has come out by stripping off the dielectric member, is used as the coaxial connector. Moreover, the shell GND of the coaxial connector is spirally inserted into the through hole which is provided in the main block formed of conductive material from the back surface side, and fixed in a state where its back end portion is projected from the back surface side, and at the same time, the core conductor is projected from the surface of the main block. Therefore, as compared with the related-art structure using the coaxial connector of the SMA type, the dielectric member projecting from the shell GND is made shorter in size. As the results, there is no anxiety that the impedance may become unstable due to the gap between the outer peripheral surface of the long-sized dielectric member as in the related art and the inner peripheral surface of the through hole of the main block. Moreover, a coaxial cable may be connected to a back end portion of the shell GND which is projected from the back surface of the main block. Further, the gap between the main block and the shell GND of the coaxial connector which is fixed thereto as in the related art is eliminated, and continuity of the impedance will not be lost. Therefore, as compared with the conventional structure in which the core conductor of the coaxial connector is electrically connected to the terminal electrode by soldering, and the shell GND of the coaxial connector is electrically connected to the GND electrode by soldering, substantially the same characteristic value can be obtained in the entire frequency zone. Further, because the electrical connection is not achieved by soldering, such complicated work that the core conductor of the coaxial connector is electrically connected to the terminal electrode which is provided at the end of the surface of the board by soldering, and the shell GND of the coaxial connector is electrically connected to the GND electrode which is provided at the end of the back surface of the board by soldering, in the same manner as in the related-art relay connector disclosed in JP-A-2008-171801, is not required.

Moreover, according to an aspect of the invention, the connecting members are provided on both the side surfaces of the main block, and the main block and the base block are fixed to the frame bodies which are arranged outside the connecting members, in such a manner that the connecting members can move between the main block and the frame bodies within a determined range in a direction parallel to the shaft. Therefore, movements of the connecting members in a lateral direction (outward) of the main block are regulated. In this manner, by moving the operating member, it is possible to reliably move the GND block by way of the connecting members. Moreover, along with the swinging operation of the operating lever which is provided on the frame bodies so as to swing, it is possible to easily press the operating member to move toward the main block or release it from the pressed state by means of the cam part which is provided on the operating lever.

Further, according to an aspect of the invention, by engaging the projected parts which are provided on both the side surfaces of the main block with the elongated holes which are provided in the connecting members and longer in a direction parallel to the shaft, it is possible to move the connecting members, without deflection, with respect to the main block within a determined range in the direction parallel to the shaft.

Still further, according to an aspect of the invention, the surface GND rest part which is provided on the main block comes into contact with the GND electrode which is provided on the surface of the board to be electrically connected, and the core conductor is slightly slackened to be elastically contacted with the terminal electrode on the surface of the board. In this manner, it is possible to deal with the board which is provided with the GND electrode on the surface.

What is claimed is:

1. A relay connector in which a core conductor of a coaxial connector is electrically connected to a terminal electrode which is provided at an end of a surface of a board, and a shell GND of the coaxial connector is electrically connected to a GND electrode which is provided at an end of a back surface of the board, the shell GND having a substantially columnar outer shape, the relay connector comprising:

a conductive first block having a first surface and a second surface being opposite to the first surface, the first block formed with a through hole, the coaxial connector being provided in the through hole, a part of the shell GND being provided in the through hole, the core conductor of the coaxial connector being projected from the first surface of the first block;

a conductive second block provided with a board rest part on which the board is to be placed, the second block operable to relatively move with respect to the first block and being electrically connected to the first block;

a third block;

a shaft extending in a direction perpendicular to an axial direction of the coaxial connector and passing through the second block, the shaft one end of which is fixed to the first block and the other end of which is fixed to the third block;

an elastic member provided between the first block and the third block;

a connecting member operable to relatively move with respect to the first block in a direction parallel to the shaft and fixed to the second block; and an operating member fixed to the connecting member and provided at an opposite side to the second block with respect to the first block, wherein when the operating member is pressed to move toward the first block, the second block moves in a direction of separating from the first block against an elastic force of the elastic member so that the board rest part relatively moves in a direction of separating from the core conductor, whereby a distance between the core conductor and the board rest part is enlarged for enabling the board to be inserted between the core conductor and the board rest part, and when a pressure on the operating member is released, the second block moves to approach the first block with an elastic force of the elastic member, whereby the board, inserted between the core conductor and the board rest part, is clamped between the core conductor and the board rest part.

2. The relay connector according to claim 1, wherein the coaxial connector is a spark plug type, the shell GND covers a dielectric member, a screw is formed on an outer peripheral surface of the shell GND, the core conductor is stripped off from the dielectric member, and a part of the shell GND of the coaxial connector is projected from the second surface of the first block.

3. The relay connector according to claim 1, wherein the first block has a third surface and a fourth surface being opposite to the third surface, which are connected to the first and second surfaces, the connecting member includes two connecting members provided on the third and fourth surfaces, the first block and the third block are fixed to frame bodies which are arranged outside the connecting members, the connecting members can move between the first block and the frame bodies, an operating lever is swingably provided on the frame bodies, at an opposite side to the first block with respect to the operating member, and along with swinging operation of the operating lever, the operating member is pressed to move toward the first block or the pressure on the operating member is released by means of a cam part provided on the operating lever.

4. The relay connector according to claim 3, wherein the connecting members are formed with elongated holes each of which extends in a direction parallel to the shaft and has a length, the first block is provided with projected parts to be engaged with the elongated holes, at the third and fourth surfaces, and each of the projected parts includes two projections which are provided at a shorter interval than the length, or a rib which is shorter than the length.

5. The relay connector according to claim 1, wherein a conductive surface GND rest part is provided on the first surface of the first block at an opposite side to the second block with respect to the core conductor and has a surface opposed to the board rest part of the second block and a recess for avoiding a contact with the core conductor, the surface of the surface GND rest part is parallel to the board rest part and is positioned slightly apart from a position where the core conductor is closest to the board rest part, and when the board is clamped between the core conductor and the board rest part, the core conductor is slightly slackened to be elastically in contact with the terminal electrode of the board and the surface GND rest part is elastically in contact with the GND electrode of the board.

* * * * *